United States Patent [19]

Ito et al.

[11] Patent Number: 4,708,891

[45] Date of Patent: Nov. 24, 1987

[54] METHOD FOR MANUFACTURING POLISHING CLOTHS

[75] Inventors: Hajime Ito, Izumisano; Junichi Miwa, Sennan, both of Japan

[73] Assignee: Toyo Cloth Co., Ltd., Sennan, Japan

[21] Appl. No.: 832,295

[22] Filed: Feb. 24, 1986

[30] Foreign Application Priority Data

Dec. 16, 1985 [JP] Japan ..... 60-284072

[51] Int. Cl.[4] ..... B05D 3/00; B05D 3/02; B05D 3/12; B05D 5/00

[52] U.S. Cl. ..... 427/245; 427/246; 427/289; 427/342

[58] Field of Search ..... 427/246, 245, 342, 289

[56] References Cited

U.S. PATENT DOCUMENTS 4,511,605 4/1985 McCartney ..... 427/342 X
4,535,008 8/1985 Naka et al. ..... 427/246
4,554,198 11/1985 Blücher et al. ..... 427/246 X

*Primary Examiner*—Evan K. Lawrence
*Attorney, Agent, or Firm*—Millen & White

[57] ABSTRACT

A method for manufacturing polishing cloths of the class to be used with abrasive powders on a lapping machine is disclosed. The method comprises the steps of impregnating a nonwoven fabric sheet with a solution of polyurethane elastomer, wet-coagulating the impregnated sheet, and heating the resulting microporous composite sheet at a temperature higher than the softening point of the polyurethane elastomer under an essentially uncompressed condition.

6 Claims, 1 Drawing Figure

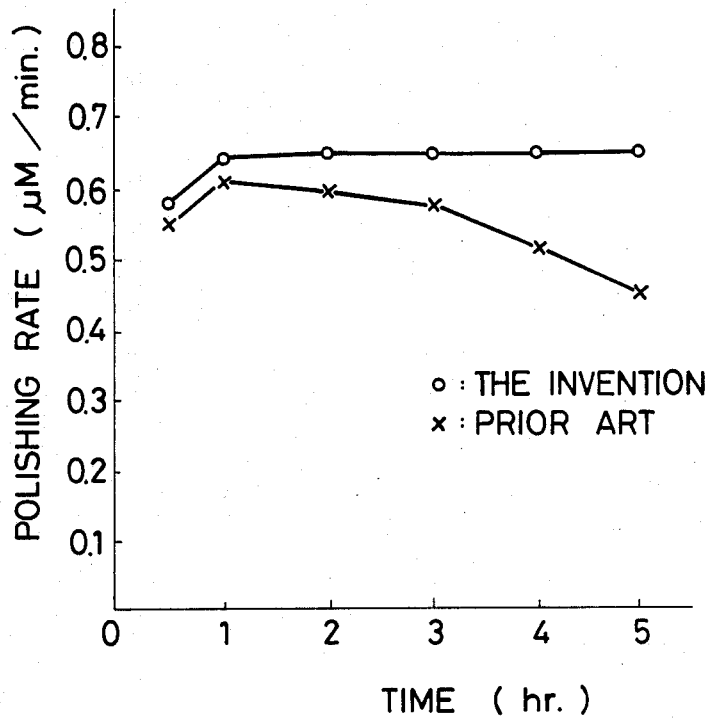
POLISHING RATE ( μM / min. )
0.8
0.7
0.6
0.5
0.4
0.3
0.2
0.1
0
1
2
3
4
5
TIME ( hr. )
o : THE INVENTION
x : PRIOR ART

METHOD FOR MANUFACTURING POLISHING CLOTHS

BACKGROUND OF THE INVENTION

This invention relates to the manufacture of polishing cloths of the class to be used with an abrasive powder or slurry for polishing various work pieces on a lapping machine.

Japanese Patent Publication No. 30158/1979 discloses a polishing cloth of the above type made of microporous polyurethane sheet materials. The microporous polyurethane sheet is produced using the well-known wet coagulation process by impregnating a substrate fabric with a solution of polyurethane elastomer in a solvent, and immersing the impregnated fabric in a liquid which is a nonsolvent for polyurethane elastomer but miscible with said solvent so that polyurethane solution is coagulated into a microporous structure. The polishing cloth is produced by compressing the resulting sheet at a temperature above the softening point of the polyurethane elastomer to impart the sheet with an adequate hardness.

Experiments have shown, however, that the resulting polishing cloths produced by the above known process have certain disadvantages and thus are far from satisfactory. The compression under heat tends to partially collapse pores and reduce their sizes in terms of greatly decreased air-permeability. In addition, the pores may be easily clogged with abrasive powder particles with the result being decreased polishing efficiency and also increased scratches on the work piece surfaces. If the polishing cloth is too soft, it is difficult to maintain flatness accuracy free from relief on the polished surface particularly when the polishing is carried out at high speeds under high pressures.

SUMMARY OF THE INVENTION

It is, therefore, the principal object of this invention to provide a process for manufacturing a microporous polyurethane based polishing cloth having improved properties.

According to the invention, there is provided a method for manufacturing a polishing cloth comprising the steps of impregnating a nonwoven fabric sheet made of a synthetic fiber having a melting point higher than that of polyurethane elastomer with a solution containing polyurethane elastomer, wet-coagulating the impregnated sheet to form a microporous composite sheet, and heating the resulting sheet in an essentially uncompressed condition at a temperature higher than the softening point of said polyurethane elastomer for a sufficient length of time to impart to the sheet a degree of hardness greater than 80 and an air-permeability greater than 25 cc/cm$^2$/second.

BRIEF DESCRIPTION OF THE DRAWING

The single FIGURE shows the difference in the polishing rates of a polishing cloth according to this invention and a prior art polishing cloth over a period of five hours.

DETAILED DESCRIPTION OF THE INVENTION

Nonwoven fabrics which may be used in this invention are those made from synthetic fibers having a melting point higher than that of polyurethane elastomer. Examples of fiber materials include polyesters such as polyethylene terephthalate and its copolymers, and nylons such as nylon 6 and nylon 66. Short staple or filaments are employed. The fabrics preferably have a thickness from 2 to 10 mm and a basis weight from 300 to 1500 g/m$^2$.

The polyurethane solution used for impregnating the nonwoven fabric may be those conventionally used for the manufacture of synthetic leather by the wet coagulation process. The solution may additionally contain other polymers such as polyvinyl chloride, polymethyl methacrylate and acrylonitrile-styrene rubber in an amount of up to equal parts by weight of polyurethane elastomer. The polymer concentration in the polyurethane solution may vary depending upon the desired deposit amount of polymer to the fabric and generally ranges from 5 to 30% by weight. The deposit amount of polymer, in turn, varies with the intended use of particular polishing cloths and generally ranges from 40 to 260% by weight of the substrate fabric on dry basis. After impregnating with the polyurethane solution, the fabric may be treated by the well-known wet coagulation technique, washed with water and then dried to give a microporous composite sheet having open cell structure. The resulting microporous sheet is preferably sliced adjacent its opposite surfaces to remove skin layers. If necessary the remainder may be further sliced into two or more sheets each having a thickness of 0.5 to 5 mm. Alternatively, this slicing operation may be carried out after the entire microporous sheet has been heat-treated as fully discussed below.

We have found that when the polyurethane microporous composite sheet is heated at a temperature higher than the softening point of polyurethane elastomer under essentially uncompressed condition, it is possible to increase the air-permeability of the sheet while imparting an adequate hardness to the sheet. The porosity of the microporous sheet substantially remains unchanged by this heat treatment. This indicates that walls defining micropores are partially fused together to form larger pores. The temperature at which the microporous sheet is treated may vary with the length of treating time and generally ranges from 180° C. to 250° C. The treating time generally ranges from 2 to 45 minutes. The lower treating temperature requires the longer treating time and vice versa. Of course a temperature higher than the melting point of the material of substrate fabric should be avoided.

This heat treatment is preferably carried out by blowing hot air or hot inert gas under such conditions that the microporous sheet is not compressed at all or compressed slightly, i.e. less than 10% in the thickness. This heat treatment is continued until the resulting product has a degree of hardness greater than 80 and an air-permeability greater than 25 cc/cm$^2$/second as determined by Japanese Industrial Standard (JIS) K 6301-1975, 5.2 and L 1096-1979, 6.27, respectively, as described hereinafter. These parameters are required for polishing work pieces without clogging while maintaining surface flatness and preventing relief.

The heat treatment of this invention may enhance the hardness and air-permeability of the cloth to at least 1.02 times, preferably 1.05 to 1.2 times and at least 1.5 times, preferably 1.6 to 2.3 times, respectively, greater than their original values.

After the heat treatment, the resulting product may be buffed to finish into smooth surfaces.

The following examples will further illustrate this invention. All percents therein are by weight unless otherwise indicated.

EXAMPLE 1

A polyester staple nonwoven fabric having a thickness of 5 mm and a basis weight of 700 g/m$^2$ was impregnated with a solution of polyurethane elastomer (TC-66, sold by Dainippon Ink And Chemicals, Inc.) in dimethylformamide having varying concentrations at a rate of 6.1 kg/m$^2$. The impregnated sheet was immersed in a 7% aqueous solution of dimethylformamide to coagulate the polyurethane solution, thoroughly washed with water and then dried. The resulting microporous composite sheet was sliced adjacent the opposite surfaces to remove skin layers. The remainder was further sliced at the center into two sheets each having a thickness of 2 mm.

The sliced sheets were heat-treated by blowing hot air having a temperature of 230° C. for 4 minutes and then buffed to finish into smooth surfaces. (Run Nos. 1–3)

The above process was repeated except that a solution of a mixture (8:2) of polyurethane elastomer and polyvinyl chloride resin dissolved in dimethylformamide at a concentration of 18% was used. (Run No. 4)

For comparative purposes, the sliced microporous composite sheets as used in Run Nos. 1–3 were treated by the method disclosed in hereinbefore cited Japanese Patent Publication No. 30158/1979. The sheets were placed in a hot press and heated at 165° C. at a pressure of 8 kg/cm$^2$ for 30 seconds to a compression degree of 53%. (Run Nos. 5–7) Properties of samples before and after the heat treatment are shown in Table 1 below.

TABLE 1

| Run No. | 1 | 2 | 3 | 4 | 5 | 6 | 7 |
|---|---|---|---|---|---|---|---|
| Polymer concentration, % | 10 | 15 | 18 | 18 | 10 | 15 | 18 |
| Amount of solid deposit, % | 85 | 130 | 155 | 155 | 85 | 130 | 155 |
| Hardness, degree | | | | | | | |
| Before treatment | 69 | 76 | 82 | 85 | 69 | 76 | 82 |
| After treatment | 81 | 83 | 87 | 90 | 91 | 93 | 94 |
| Ratio of After/Before | 1.17 | 1.09 | 1.06 | 1.06 | 1.32 | 1.22 | 1.15 |
| Air-permeability, cc/cm$^2$/sec. | | | | | | | |
| Before treatment | 22.0 | 16.5 | 13.4 | 13.4 | 22.0 | 16.5 | 13.4 |
| After treatment | 44.7 | 37.2 | 27.4 | 26.1 | 1.11 | 0.72 | 0.72 |
| Ratio of After/Before | 2.03 | 2.25 | 2.04 | 1.95 | 0.05 | 0.04 | 0.05 |
| Porosity, % | | | | | | | |
| Before treatment | 81.0 | 77.2 | 75.2 | 68.2 | 81.0 | 77.2 | 75.2 |
| After treatment | 78.3 | 79.5 | 75.0 | 68.9 | 41.4 | 39.5 | 39.2 |
| Ratio of After/Before | 0.97 | 1.03 | 1.00 | 1.01 | 0.51 | 0.51 | 0.52 |
| Pore size, μm | | | | | | | |
| Before treatment | 45 | 25 | 20 | 17 | 45 | 25 | 20 |
| After treatment | 150 | 85 | 80 | 65 | 25 | 15 | 10 |
| Ratio of After/Before | 3.3 | 3.4 | 4.0 | 3.8 | 0.6 | 0.6 | 0.5 |
| Pore sectional area, μm$^2$ | | | | | | | |
| Before treatment | 1635 | 640 | 345 | 278 | 1635 | 640 | 345 |
| After treatment | 7675 | 3835 | 2720 | 1710 | 340 | 280 | 240 |
| Ratio of After/Before | 4.7 | 6.0 | 7.9 | 6.2 | 0.2 | 0.4 | 0.7 |

EXAMPLE 2

The procedures of Run Nos. 1–3 and 5–7 in Example 1 were repeated except that the polyester nonwoven fabric was replaced by a nylon 6 nonwoven fabric (Run Nos. 8–10 and 12–14, respectively) or a nylon/polyester (1:1) mixed fiber nonwoven fabric (Run Nos. 11 and 15, respectively) and the heat treatment was carried out at 210° C. for 4 minutes.

Properties of samples before and after the heat treatment are shown in Table 2 below.

TABLE 2

| Run No. | 8 | 9 | 10 | 11 | 12 | 13 | 14 | 15 |
|---|---|---|---|---|---|---|---|---|
| Polymer concentration, % | 10 | 15 | 18 | 18 | 10 | 15 | 18 | 18 |
| Amount of solid deposit, % | 85 | 130 | 155 | 155 | 85 | 130 | 155 | 155 |
| Hardness, degree | | | | | | | | |
| Before treatment | 72 | 76 | 83 | 80 | 72 | 76 | 83 | 80 |
| After treatment | 81 | 85 | 88 | 87 | 93 | 93 | 96 | 95 |
| Ratio of After/Before | 1.13 | 1.11 | 1.06 | 1.09 | 1.29 | 1.26 | 1.16 | 1.19 |
| Air-permeability, cc/cm$^2$/sec. | | | | | | | | |
| Before treatment | 18.5 | 14.8 | 12.8 | 10.9 | 18.5 | 14.8 | 12.8 | 10.9 |
| After treatment | 35.3 | 29.5 | 26.5 | 25.3 | 1.31 | 0.92 | 0.65 | 0.65 |
| Ratio of After/Before | 1.91 | 1.99 | 2.07 | 2.32 | 0.07 | 0.06 | 0.05 | 0.06 |
| Porosity, % | | | | | | | | |
| Before treatment | 78.2 | 73.0 | 71.3 | 70.3 | 78.2 | 73.0 | 71.3 | 70.3 |
| After treatment | 75.1 | 72.3 | 69.2 | 69.0 | 38.2 | 32.1 | 30.1 | 30.7 |
| Ratio of After/Before | 0.96 | 0.99 | 0.97 | 0.98 | 0.49 | 0.44 | 0.42 | 0.44 |
| Pore size, μm | | | | | | | | |
| Before treatment | 40 | 20 | 17 | 17 | 40 | 20 | 17 | 17 |
| After treatment | 145 | 70 | 60 | 60 | 25 | 15 | 10 | 10 |
| Ratio of After/Before | 3.6 | 3.5 | 3.5 | 3.5 | 0.6 | 0.8 | 0.6 | 0.6 |
| Pore sectional area, μm$^2$ | | | | | | | | |
| Before treatment | 1550 | 500 | 300 | 285 | 1550 | 500 | 300 | 285 |
| After treatment | 6200 | 2620 | 1860 | 1840 | 380 | 250 | 220 | 200 |

TABLE 2-continued

| Run No. | 8 | 9 | 10 | 11 | 12 | 13 | 14 | 15 |
|---|---|---|---|---|---|---|---|---|
| Ratio of After/Before | 4.0 | 5.2 | 6.2 | 6.5 | 0.2 | 0.5 | 0.7 | 0.7 |

As can be seen from Table 1 and Table 2, the treatment according to this invention greatly increased the air-permeability, pore size and pore sectional area, whereas the known technique decreased these characteristics significantly. The porosity remained substantially unchanged by the treatment of this invention but decreased about one half by the known technique. Both techniques were effective to improve the hardness.

In the above tests, hardness was determined by the method according to JIS K6301-1975, 5.2, using a rubber hardness meter (C-type, Kobunshi Keiki Co., Ltd.). This method is an indentation-type test employed to measure the hardness of rubber, in which a spring loaded (5,000 gf) indentor rod which narrows at a 35° angle to a smaller flat tip which is pressed through a hole not less than 10 mm in dia.) in a flat loading disc resting on the flat surface of a piece of the material which is larger than the loading disc and at least 6 mm thick. If the indentor intends the test material by 2.54 mm, i.e., projects 2.54 mm beyond the lower surface of the loading disc, it receives a hardness value of 0 in the test and if it does not indent the test material, i.e., the tip of the indentor is level with the lower surface of the loading disc, the test material receives a hardness value of 100 in the test.

Air-permeability was determined by the method according to JIS L1096, 6.27, using a Frazir type air-permeability tester. This test equipment employs a suction fan mounted on the lower end of a vertical cylinder having a partition with an air hole in it mounted in the middle of the cylinder and barometers fitted above and below the partition. The test material is clamped to the upper end of the cylinder to form a porous lid. The speed of the fan is adjusted to provided a standard pressure differential of (1.27 cm $H_2O$) in the upper chamber. By use of a conversion table, the barometric pressure in the lower chamber gives the air permeability of the test material in terms of the air volume which passes through the tester ($cm^3/cm^2/s$). The test is conducted 5 times and the results averaged.

Porosity was determined by the following method. A quantity of methanol is placed in a graduated cylinder to a predetermined level. Then the sample is completely immersed in methanol and the increment in total volume is measured (n cc). Thereafter the sample is withdrawn from the cylinder and the decrease in the volume of methanol (m cc) is measured. The porosity may be calculated by the following equation:

$$\text{Porosity}=[m/(n+m)]\times 100$$

The pore size and pore sectional area were determined using electron-micrographs. These data represent average values.

EXAMPLE 3

Run Nos. 1 and 3 in Example 1 were repeated at varying temperatures and varying treating times. Increase in the hardness and air-permeability was determined in terms of the ratio of these values after the treatment relative to the corresponding values before the treatment. The results are shown in Table 3 below.

TABLE 3

| | | Run No. | | | |
|---|---|---|---|---|---|
| | | 1 | | 3 | |
| | | Polymer conc., % | | | |
| | | 10 | | 18 | |
| Temp., °C. | Time, min. | Hardness | Air-permeability | Hardness | Air-permeability |
| 170 | 45 | 1.10 | 1.05 | — | — |
| 180 | 45 | 1.16 | 1.62 | 1.01 | 1.42 |
| 190 | 45 | — | — | 1.05 | 1.89 |
| 200 | 17 | 1.16 | 1.92 | 1.05 | 1.95 |
| 240 | 3 | 1.20 | 1.95 | 1.06 | 2.03 |
| 250 | 2 | 1.25 | 0.74 | 1.05 | 2.07 |
| 260 | 1.5 | — | — | 1.10 | 0.10 |

EXAMPLE 4

Run Nos. 8 and 10 of Example 2 were repeated at varying temperatures and varying treating times. Increase in the hardness and air-permeability was determined in terms of the ratio of these values after the treatment relative to the corresponding values before the treatment.

The results are shown in Table 4 below.

TABLE 4

| | | Run No. | | | |
|---|---|---|---|---|---|
| | | 8 | | 10 | |
| | | Polymer conc., % | | | |
| | | 10 | | 18 | |
| Temp., °C. | Time, min. | Hardness | Air-permeability | Hardness | Air-permeability |
| 170 | 45 | 1.14 | 1.28 | 1.05 | 1.18 |
| 180 | 45 | 1.14 | 1.62 | 1.05 | 1.51 |
| 190 | 10 | 1.17 | 2.03 | 1.07 | 1.77 |
| 200 | 5 | 1.18 | 2.11 | 1.08 | 2.01 |
| 210 | 5 | 1.21 | 2.20 | 1.10 | 2.27 |
| 220 | 5 | 1.35 | 0 | 1.17 | 0 |

As can be seen in Table 4, the air-permeability decreased to zero by the treatment at 220° C. for five minutes because of melting of the nylon 6.

Polishing test

Using polishing cloths obtained in Run Nos. 3 and 7 in Example 1, a high quality silicon wafer for use in the manufacture of integrated circuit substrates was polished. The machine used in the test was Model LM-600 sold by Techno Co., Ltd. The polishing conditions were as follows:

Abrasive powder: colloidal silica
Slurry concentration: Abrasive powder:$H_2O$=1:19
Slurry pH: 10.3
Temperature: 23° C.
Slurry flow rate: 2.3 liter/min.
Coolant flow rate: 1 liter/min.
Lap wheel rotation: 100 rpm.
Work piece pressure: 400 $g/cm^2$
Dressing: every 30 minutes polishing The change of polishing rate against time is shown in the accompanying drawing. In case of the polishing cloth produced by the method of this invention, the polishing rate remained constant over more than five hours and the work piece retained excellent flatness accuracy. No machining scratch was observed on the polished surface. On the other hand, the polishing cloth produced by the prior art method was clogged with abrasive powder only after 1 hour operation and the polishing rate gradually decreased thereafter. A number of machining scratches were observed on the polished surface.

While particular embodiments of the invention have been described, various modifications may be made without departing from the true spirit and the scope of the invention which is defined in the appended claims.

We claim:

1. A method for producing a polyurethane-based polishing cloth which comprises the steps of:

impregnating, with a solution containing a polyurethane elastomer, a nonwoven fabric sheet made of a synthetic fiber having a melting point higher than that of said polyurethane elastomer;

wet-coagulating the resulting impregnated sheet to form a microporous composite sheet; and heating the resulting composite sheet in an essentially uncompressed condition at a temperature higher than the softening point of the polyurethane elastomer and lower than the melting point of the synthetic fiber for a sufficient length of time to impart to the sheet a degree of hardness greater than 80 and an air-permeability greater than 25 $cc/cm^2/second$.

2. The method according to claim 1, wherein said heating step is carried out at a temperture from 180° C. to 250° C. for 2 to 45 minutes.

3. The method according to claim 1, wherein said nonwoven fabric sheet has a thickness from 2 to 10 mm and a basis weight from 300 to 1500 $g/m^2$.

4. The method according to claim 1, wherein said polyurethane solution additionally contains up to equal parts by weight of the polyurethane elastomer of polyvinyl chloride, polymethyl methacrylate or styrene-acrylonitrile rubber.

5. The method according to claim 1 further including the step of slicing the microporous composite sheet adjacent its opposite surfaces to remove skin layers before or after said heating step.

6. The method according to claim 5 further including, after removal of said skin layers, the step of slicing the microporous composite sheet remainder into two or more sheets.

* * * * *